United States Patent [19]

Wahle

[11] 4,011,876

[45] Mar. 15, 1977

[54] DEVICE FOR WITHDRAWING TOBACCO FROM THE MAGAZINE OF A TOBACCO DISTRIBUTOR

[75] Inventor: Gunter Wahle, Reinbek, Germany

[73] Assignee: Haüni-Werke Korber & Co., KG, Hamburg, Germany

[22] Filed: May 15, 1975

[21] Appl. No.: 577,750

[30] Foreign Application Priority Data

June 4, 1974 United Kingdom ..... 24593/74

[52] U.S. Cl. ..... 131/109 R; 131/109 AB

[51] Int. Cl.[2] ..... A24C 1/02; A24C 5/39

[58] Field of Search ..... 131/109 R, 109 AB, 109 B, 131/110; 19/97, 97.5

[56] References Cited

UNITED STATES PATENTS

| | | | |
|---|---|---|---|
| 1,916,137 | 6/1933 | Gwinn | 131/109 R |
| 2,447,457 | 8/1948 | Arelt | 131/109 AB |
| 2,791,222 | 5/1957 | Dearsley | 131/109 AB |
| 2,833,290 | 5/1958 | Molins | 131/109 R |
| 3,443,688 | 5/1969 | Molins | 131/110 |

*Primary Examiner*—John F. Pitrelli
*Attorney, Agent, or Firm*—Peter K. Kontler; John Kurucz

[57] ABSTRACT

A tobacco distributor wherein a toothed drum withdraws a continuous layer of tobacco shreds from a magazine. The teeth impart to the periphery of the drum a saw-tooth profile and their trailing flanks have outwardly and forwardly extending pins. The pins withdraw relatively long shreds and the leading flanks of the teeth withdraw relatively short shreds when the drum is rotated to move successive teeth along an open side of the magazine wherein tamping members push tobacco shreds into the range of teeth and pins. The layer is thereupon converted into a wide carpet, and the carpet is converted into a narrow tobacco stream ready for trimming or immediate draping into cigarette paper.

10 Claims, 2 Drawing Figures

DEVICE FOR WITHDRAWING TOBACCO FROM THE MAGAZINE OF A TOBACCO DISTRIBUTOR

BACKGROUND OF THE INVENTION

The present invention relates to distributors for tobacco, especially to distributors which are used in cigarette making machines to form a relatively wide silver or fleece consisting of tobacco shreds and ready for conversion into a narrow tobacco stream which is suitable for trimming or immediate wrapping into cigarette paper.

A tobacco distributor in a cigarette making machine comprises a magazine for a supply of tobacco shreds, a carded drum which withdraws a layer of tobacco particles from the magazine, and additional components which equalize the layer and segregate heavier particles, such as fragments of ribs, birds' eyes, pieces of metal, sand, rock and the like. The additional components include picker rollers, refuser rollers, winnowers, brushes and other moving parts.

Problems arise in conventional distributors because the supply of tobacco is the magazine of a distributor contains shorter and longer tobacco shreds. As a rule, the carding of the aforementioned drum is more likely to withdraw longer shreds so that the shorter shreds tend to accumulate in the magazine and are removed sporadically in the form of relatively large coherent clumps. The shorter shreds continue to adhere to each other during further processing in the distributor and are likely to form, by themselves, certain portions of the fleece and thereupon of the narrow tobacco stream. This is undesirable because accumulations of shorter shreds affect the quality of cigarettes, especially because shorter shreds are more likely to escape at the ends of wrappers so that the heads of cigarettes containing relatively large quantities of short shreds are too soft. The formation of relatively short shreds cannot be avoided; such shreds invariably constitute a certain percentage of tobacco in the magazine of a distributor. It has been found that the carding of a conventional drum which is used to withdraw a continuous layer of tobacco shreds from the magazine acts not unlike a classifying device which segregates longer shreds from shorter shreds and removes the thus obtained accumulations of shorter shreds at irregular intervals.

SUMMARY OF THE INVENTION

An object of the invention is to provide a novel and improved tobacco distributor for use in cigarette making or like machines, and more particularly to provide the distributor with novel and improved means for removing a continuous layer of tobacco shreds from a magazine which contains a relatively large supply of randomly intermixed shorter and longer shreds.

Another object of the invention is to provide the distributor with a tobacco withdrawing or removing device which does not discriminate between different types of tobacco particles, especially between longer and shorter shreds, so that the distribution of shorter and longer shreds in the layer, silver and tobacco stream is just as uniform as in the supply of such shreds in the interior of the magazine.

A further object of the invention is to provide a novel and improved tobacco withdrawing drum or belt which can be utilized as a superior substitute for conventional carded drums or belts.

An additional object of the invention is to provide a cigarette making machine which embodies the improved distributor and its tobacco withdrawing device and, consequently, turns out smaller quantities of cigarettes having unsatisfactory heads.

The invention is embodied in a tobacco distributor for cigarette making or like machines. The distributor comprises a magazine serving to store a preferably substantial supply of tobacco particles, particularly a supply consisting mainly of relatively long and relatively short tobacco shreds, and a novel and improved device for withdrawing tobacco from the supply in the magazine. The withdrawing device comprises an entraining member (e.g., a rotary drum) having an annulus of teeth separated from each other by tooth spaces or gaps and carrying outwardly extending pin- or needle-like projections, and means for moving the teeth along an endless path a portion of which is adjacent to the supply of tobacco in the magazine so that the teeth and projections which advance along such portion of the endless path remove from the supply a substantially continuous layer of tobacco particles.

It has been found that the projections remove primarily longer shreds and that the front or leading flanks of the teeth (as considered in the direction of movement of the entraining member) entrain relatively short shreds. Thus, the percentage of shorter shreds in successive unit lengths of the layer is identical with or does not deviate appreciably from the percentage of shorter tobacco shreds in the supply of tobacco particles in the magazine.

If the entraining member is a drum, the teeth are provided at its periphery and preferably extend in parallelism with the axis of the drum all the way from the one to the other end face. The projections preferably extend forwardly and outwardly from the trailing flanks of the teeth; each such tooth can carry at least one row of projections. The teeth at the periphery of the drum preferably impart to the periphery a saw-tooth profile; the front flakes of the teeth may but need not extend substantially radially of the drum.

The novel features which are considered as characteristic of the invention are set forth in particular in the appended claims. The improved withdrawing device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
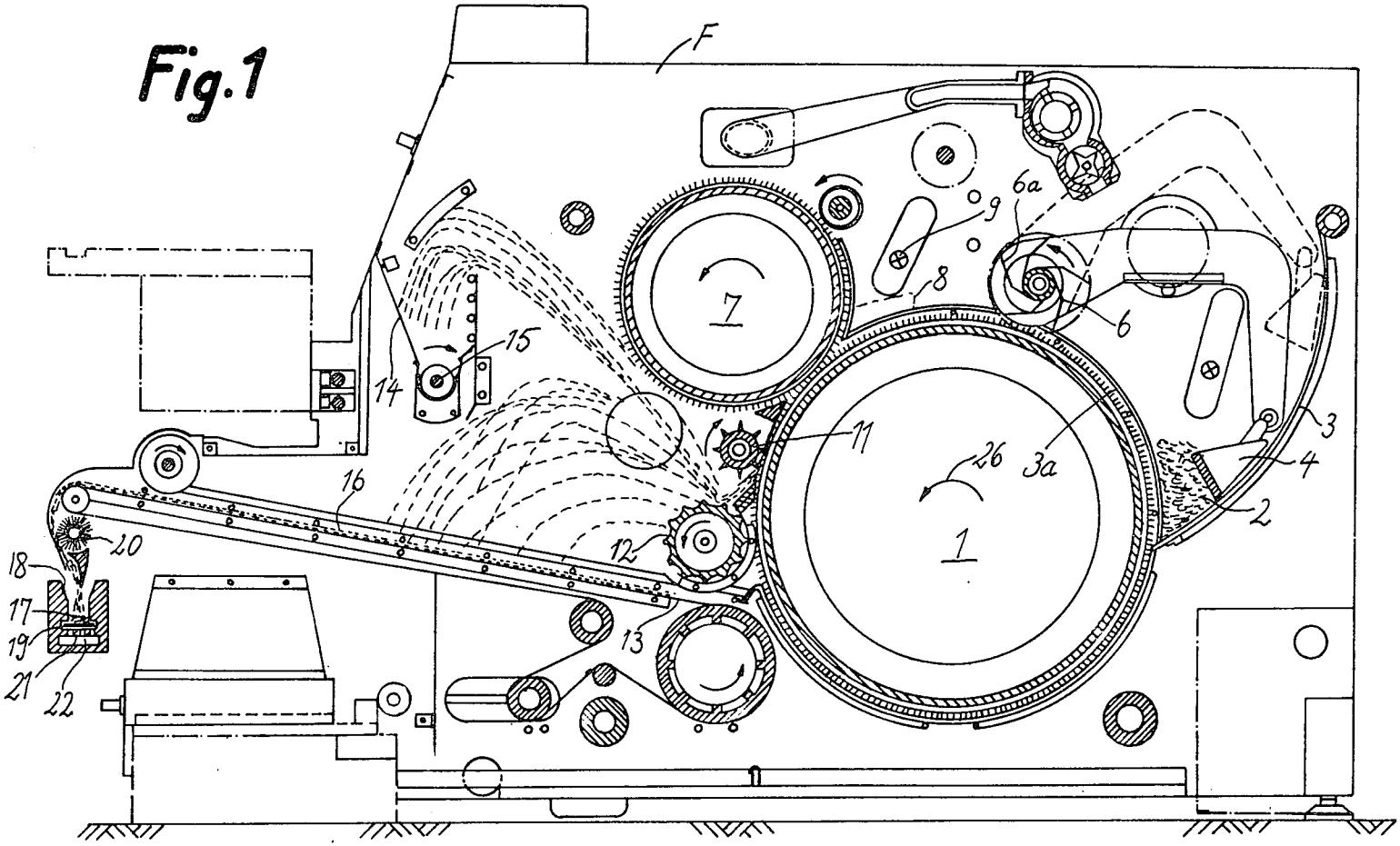
FIG. 1 is a schematic longitudinal vertical sectional view of a tobacco distributor including a drum-shaped withdrawing device which embodies the invention.
Figure 2:
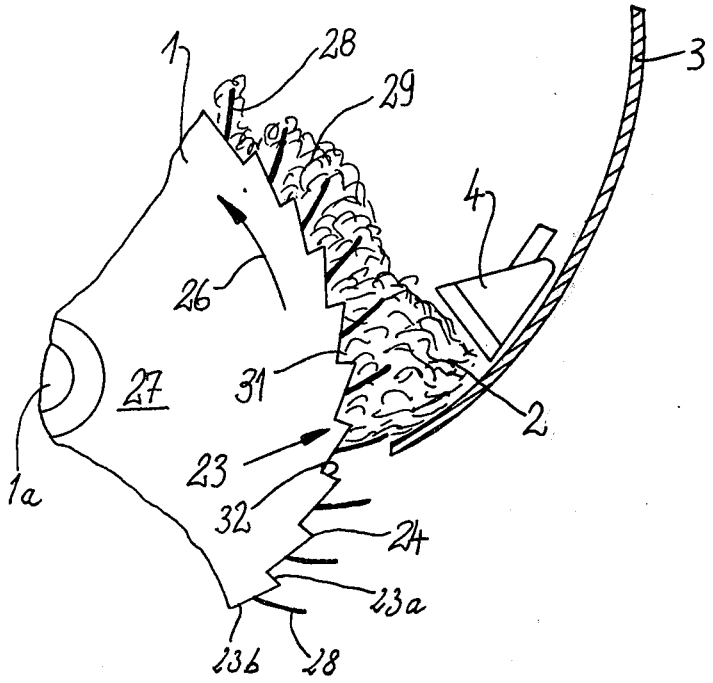
FIG. 2 is an enlarged fragmentary elevational view of the withdrawing device and a sectional view of a portion of the magazine.

The distributor which is shown in FIGS. 1 and 2 is mounted in the frame F of a cigarette making machine, e.g., a machine known as GARANT (trademark) produced by Hauni-Werke, Hamburg, Western Germany. This distributor comprises a magazine or hopper 3 for a relatively large supply 2 of randomly but normally rather uniformly distributed shorter and longer tobacco shreds 31, 29. As a rule, the supply 2 in the magazine 3 also contains a relatively low percentage of comminuted tobacco ribs, birds' eyes and eventually a few fragmentized foreign substances, such as pieces of metal, sand or rock. One side of the magazine 3 is open, as at 3*a*, so that a continuous layer of tobacco shreds can be removed by a novel withdrawing or entraining member 1 here shown as a drum which is driven by a horizontal shaft 1*a* so as to rotate anti-clockwise (see the arrow 26). The magazine 3 contains one or more mobile tamping members 4 serving as a means for moving shreds (29, 31) into the range of teeth 23 at the periphery of the drum 1.

The layer of tobacco shreds which is removed by the drum 1 is partially equalized by a paddle wheel 6 having elastic vanes or paddles 6*a* and being driven to rotate counterclockwise, as viewed in FIG. 1. The layer is thereupon equalized again by a driven carded refuser roller 7 which is followed by a rapidly rotating picker roller 11 serving to separate shreds from the periphery of the drum 1 and to propel the thus separated shreds against a rapidly rotating winnower 12. The latter propels the shreds onto the upper reach of a wide endless band 13 whereon the shreds form a carpet or fleece 16. The heavier constituents of the layer which is being removed from the periphery of the drum 1 have longer flight spans than the shreds 29, 31 and are propelled into an intercepting receptacle 14 for intermittent or continuous transport to a further processing station through the medium of a feed screw 15. The heavier tobacco particles may be utilized for the making of sheets of reconstituted tobacco.

The front edge of the carpet 16 on the upper reach of the band 13 descends into the range of a rapidly rotating brush 20 which propels the shreds into a narrow tobacco channel 18 the bottom wall of which constitutes the upper reach of a foraminous belt 19 traveling above the perforated top wall 21 of a stationary suction chamber 22 which attracts the shreds to the upper reach of the belt 19 so that such shreds form a growing tobacco stream 17 which is thereupon trimmed or immediately wrapped into a web of cigarette paper.

The surplus tobacco which is intercepted by the carding of the refuser roller 7 forms a relatively small intermediate supply 8 wherein the quantity of tobacco is monitored by a photoelectric detector 9 serving as a means for controlling the operation of a mechanism which can move the paddle wheel 6 nearer to or further away from the periphery of the drum 1. The detector 9 thus insures that the quantity of tobacco particles forming the intermediate supply 8 remains within a relatively narrow range; this contributes to uniformity of the layer which is permitted to advance beyond the nip of the drum 1 and refuser roller 7 and into the range of the picker roller 11.

In accordance with a feature of the invention, the teeth 23 impart to the periphery of the tobacco-entraining drum 1 a saw-tooth profile. Each tooth 23 preferably extends in parallelism with the axis of the shaft 1*a* and all the way from the one to the other end face 27 of the drum. Each tooth has a relatively short front or leading flank 23*a* which extends substantially radially of the drum 1 and a relatively long rear or trailing flank 23*b* which slopes rearwardly and inwardly from the top land or tip 24 of the respective tooth 23 toward the root of the next-following tooth. Each tooth 23 further carries at least one but preferably one or more rows of outwardly extending pin- or needle-like projections 28. These projections extend outwardly from the median portions of the trailing flanks 23*b* and are inclined forwardly, as considered in the direction indicated by arrow 26. The projections 28 entrain primarily the longer tobacco shreds 29 and the leading flanks 23*a* of teeth 23 entrain primarily the shorter tobacco shreds 31. This insures that the distribution of shreds in the intermediate supply 8 as well as in the shower of shreds which descend onto the upper reach of the band 13 to form the carpet 16 is the same or nearly the same as that of shorter and longer shreds in the supply 2. The extent to which the projections 28 extend outwardly beyond the top lands 24 of the respective teeth 23 has been exaggerated in FIG. 2 for the sake of clarity.

When the distributor is in use, the prime mover of the cigarette making machine drives the tamping members 4, drum 1, paddle wheel 6, refuser roller 7, picker roller 11, winnower 12, band 13, brush 20, feed screw 15 and belt 19. The teeth 23 and the projections 28 remove from the supply 2 a continuous layer of tobacco particles while moving along an endless path a portion of which extends along the open side 3*a* of the magazine 3. Such layer is equalized by the paddle wheel 6 and refuser roller 7, separated from the periphery of the drum 1 by the picker roller 11, classified by the winnower 12, and the shreds 29, 31 collected by band 13 to form the carpet 16 which is thereupon converted into the narrow stream 17.

An important advantage of the improved entraining drum 1 is that it does not perform an undesirable classification of tobacco shreds in the magazine 3, i.e., that the percentage of shorter shreds in the carpet 16 is practically identical with that of shorter shreds in the main supply 2. This is attributed to the provision of tooth spaces or grooves 32 which receive shorter shreds 29 so that such shorter shreds can be entrained by the leading flanks 23*a* of the respective teeth 23. This reduces the likelihood that the machine embodying the distributor of FIG. 1 would produce a large number of cigarettes having defective heads. The drum-shaped entraining member 1 can be replaced by an endless toothed belt.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In a tobacco distributor for cigarette making machines, a combination comprising a magazine arranged to store a supply of tobacco particles, particularly a supply consisting mainly of relatively long and relatively short tobacco shreds; and a device for withdrawing tobacco from the supply in said magazine, including an entraining member having an annulus of teeth and projections extending outwardly from said teeth, and means for moving said teeth along an endless path a portion of which is immediately adjacent to the supply of tobacco in said magazine so that the teeth and projections in said portion of said path remove, support and advance a substantially continuous layer of tobacco particles from said supply.

2. A combination as defined in claim 1, wherein said entraining member is a rotary drum and said teeth are disposed at the periphery of said drum.

3. A combination as defined in claim 2, wherein said teeth have substantially radially extending leading flanks, as considered in the direction of rotation of said drum.

4. A combination as defined in claim 2, wherein said projections are inclined forwardly, as considered in the direction of rotation of said drum.

5. A combination as defined in claim 2, wherein the periphery of said drum has a saw-tooth profile.

6. A combination as defined in claim 2, wherein said teeth are substantially parallel to the axis of rotation of said drum.

7. A combination as defined in claim 2, wherein said drum has two end faces and said teeth extend all the way from the one to the other end face of said drum.

8. A combination as defined in claim 1, further comprising means for moving the particles of said supply in said magazine into the range of teeth and projections in said path.

9. A combination as defined in claim 1, wherein said projections are pins.

10. A combination as defined in claim 1, wherein each of said teeth has a leading flank and a trailing flank, as considered in the direction of movement of said teeth along said path, and said projections extend outwardly from the trailing flanks of said teeth to entrain relatively long shreds of said supply, the relatively short shreds being entrained by the leading flanks of said teeth.

* * * * *